US008444531B1

(12) United States Patent
Johnson et al.

(10) Patent No.: US 8,444,531 B1
(45) Date of Patent: May 21, 2013

(54) VAULT BOX SAFETY COLLAR

(75) Inventors: Jan E. Johnson, Atascadero, CA (US); Ashley M. Whittaker, Mahomet, IL (US)

(73) Assignee: Litania Sports Group, Inc., Champaign, IL (US)

( * ) Notice: Subject to any disclaimer, the term of this patent is extended or adjusted under 35 U.S.C. 154(b) by 330 days.

(21) Appl. No.: 12/924,656

(22) Filed: Oct. 1, 2010

Related U.S. Application Data

(60) Provisional application No. 61/278,180, filed on Oct. 2, 2009.

(51) Int. Cl.
*A63B 5/00* (2006.01)
*A63B 5/06* (2006.01)

(52) U.S. Cl.
USPC ..... 482/15; 482/18; 482/14

(58) Field of Classification Search
USPC ..... 482/14, 15, 18, 19, 23, 25, 26
See application file for complete search history.

(56) References Cited

U.S. PATENT DOCUMENTS 2,110,254 A * 3/1938 Austin ..... 482/18
3,965,507 A * 6/1976 Reiland ..... 482/18
4,163,551 A * 8/1979 Simpson ..... 482/18
4,245,838 A * 1/1981 Gordon ..... 482/17
4,443,009 A 4/1984 Smith ..... 272/104
7,736,274 B2 * 6/2010 Thibodeaux, Sr. ..... 482/15
2004/0053747 A1 * 3/2004 Bollinger ..... 482/15
2004/0067820 A1 * 4/2004 Noble et al. ..... 482/18

OTHER PUBLICATIONS

Vault Box Collar, Gill Athletics, Inc., Champaign, Illinois, 61822. Retrieved from Internet URL: www.gillathletics.com/store/products.aspx?id=676 on Aug. 19, 2010.

* cited by examiner

*Primary Examiner* — Loan Thanh
*Assistant Examiner* — Sundhara Ganesan
(74) *Attorney, Agent, or Firm* — Philip L. Bateman

(57) ABSTRACT

A safety collar for a vault box reduces the risk of catastrophic injury if the pole vaulter lands directly onto the vault box, but does not make it more difficult for the pole vaulter to plant the pole into the vault box. The safety collar overlies the vault box and an area to the rear and the sides of the vault box. The collar has a front, a rear, a left side, a right side, and an opening extending from the front to the rear that overlies the recess of the vault box. The collar also has a left wing extending downwardly against the left wall of the vault box part way to the bottom surface and part way to the rear wall and a right wing extending downwardly against the right wall of the vault box part way to the bottom surface and part way to the rear wall.

15 Claims, 4 Drawing Sheets

VAULT BOX SAFETY COLLAR

CROSS-REFERENCE TO RELATED APPLICATION

This application claims the benefit of U.S. Provisional Application Ser. No. 61/278,180, Oct. 2, 2009.

FIELD OF THE INVENTION

This invention relates to track and field equipment. More particularly, this invention relates to pole vaulting.

BACKGROUND OF THE INVENTION

Track and field is a sport in which athletes compete in running, jumping, and throwing events. In an event known as the pole vault, an athlete uses a pole to jump over a cross bar. The pole vault originated in Europe where men used a wooden pole to cross over canals filled with water. By the late 1800s, the pole vault had been added as an event at track and field competitions. The early pole vaulters used a bamboo pole with a sharp point on the end and competed on a grassy surface. In the first modern Olympics in 1896, the winning vault was a height of ten and one-half feet (about 3.2 meters). In the following century, techniques and equipment improved so dramatically that the current record is over twenty feet (over 6.1 meters).

One of the changes in equipment that occurred in the past century was the use of a vault box for planting the pole. A vault box (also known as a planting box) is a recess permanently mounted at the end of a runway and a short distance in front of the standards and cross bar. When using a vault box, the pole vaulter runs down the runway holding the pole in a horizontal position, plants the distal end of the pole into the vault box, and then elevates.

Another one of the changes that occurred in the past century was the use of fiberglass for the pole. Compared to bamboo poles, fiberglass poles are much lighter in weight and have a much greater ability to convert energy. In terms of physics, the vaulting pole converts the kinetic energy of the running vaulter into potential energy that is used to overcome the force of gravity. There is no limit to the length of the pole. The best male vaulters use a pole that is about seventeen feet (about 5.2 meters) long while high school girls may use a pole that is only about twelve feet long (about 3.7 meters).

FIG. 1 illustrates a person 10 performing a pole vault. The vaulter holds onto a pole 20 that has been planted into a vault box 30 at the end of a runway 40. The vaulter is attempting to clear a cross bar 50 elevated between two standards 60. At the moment shown, the pole is bent at the maximum angle and is about to straighten out to propel the vaulter upward over the cross bar. For brevity, masculine pronouns are occasionally used herein.

FIG. 2 is a more detailed view of the vault box with the distal end of a pole shown in phantom lines. The size and shape of the vault box has been standardized by the various track and field governing bodies. The vault box has a length of about 43 inches (about 110 cm), a width of about 24 inches (about 60 cm) at the front, a width of about 16 inches (about 40 cm) at the rear, and a maximum depth of about 8 inches (about 20 cm). The vault box contains an outwardly sloping rear wall 31 (also known as the stop board), an outwardly sloping left side wall 32, an outwardly sloping right side wall 33, and a bottom surface 34 that slopes downwardly from front to rear. The outward slope of the side and rear walls is about 105 degrees. The vault box has two back corners, one where the rear wall, left side wall, and bottom surface meet and one where the rear wall, right side wall, and bottom surface meet. The side walls converge from front to rear at the top (along ground level) and converge from front to rear at the bottom even more than at the top. The minimum distance between them at the lowest point of the bottom is about 6 inches (about 15 cm). During the vault, the distal end of the pole moves to one of the two back corners and bends outwardly toward the other back corner as shown.

After completing the jump, the vaulter lands in a cushioned landing area on the far side of the cross bar. Early landing areas were pits filled with sawdust or sand. As the height of the jump increased, advances were made to the landing areas. A modern landing area typically consists of multiple foam blocks secured together. The foam blocks have a thickness (height) of several feet (one or more meters) so the distance from the cross bar to the top of the cushion is reduced. The landing cushion is omitted in FIG. 1 for simplicity and clarity.

Despite the use of cushioned landing areas, injuries continue to occur during pole vaulting. A major cause of injuries is the failure of the vaulter to land on the cushion at the far side of the cross bar. If the vaulter fails to place the pole into the vault box or fails to properly perform the vault, he may elevate in the wrong place or at the wrong angle, and drop back down at a place other than the landing area.

Serious injuries often occur when the vaulter drops back directly over the vault box and lands in a supine position (facing upwards). In some instances, the vaulter falls into the vault box in position that is roughly parallel to the vault box (i.e., with his spine aligned with the longitudinal axis of the vault box) as shown in FIG. 3. Severe injuries occur when the head hits the bottom of the vault box. In other instances, the vaulter falls onto the vault box in a transverse position (i.e., with his spine at an angle to the longitudinal axis of the vault box, with his shoulders at the edge of the vault box, and with his head directly over the vault box) as shown in FIG. 4. As the back and shoulders make impact, the head is thrown backward and downward into the recess. If the head is positioned over a shallow part of the recess, the head will make contact before the neck breaks and severe head trauma results. If the head is positioned over a deeper part of the recess, the neck may break before the head makes contact.

Cushioned collars that surround the vault box are commonly used. For example, a relatively thin cushioned safety collar that surrounds the sides and rear of the vault box is commercially available from Gill Athletics, Inc. of Champaign, Ill. These collars are ineffective at preventing the injuries described above when the vaulter lands into the vault box because they contain upper openings that are the same size as, or slightly larger than, the upper perimeter of the vault box. As another example, Smith, U.S. Pat. No. 4,443,009, Apr. 17, 1984, discloses a relatively thick cushion that surrounds the vault box. The recess of the cushion angles outwardly from the vault box so it does not interfere with the bending of the pole during the vault. The Smith cushion is also ineffective at preventing the injuries described above because the size of its upper opening is much larger than that of the vault box.

Narrowing the vault box to reduce the catastrophic injuries described above in which the vaulter lands directly over the vault box has not been proposed. The primary reason narrowing has not been proposed is presumably because it would increase the likelihood of other injuries resulting from a failure to plant the pole into the vault box.

Accordingly, a demand exists for a vault box safety cushion that reduces the risk of catastrophic injury if the pole vaulter lands directly onto the vault box, but does not make it more difficult for the pole vaulter to plant the pole into the vault box.

SUMMARY OF THE INVENTION

One general object of this invention is to provide an improved vault box safety collar. A more particular object is to provide a vault box safety collar that reduces the risk of catastrophic injury if the pole vaulter lands directly onto the vault box, but does not make it more difficult for the pole vaulter to plant the pole into the vault box.

We have invented a safety collar for a vault box having a recess with a bottom surface that slopes downwardly from front to rear, an outwardly sloping rear wall, an outwardly sloping left wall that converges from front to rear, and an outwardly sloping right wall that converges from front to rear. The safety collar comprises: (a) a cushioned sheet of material adapted to overlie a surface adjacent to the rear and the left and right sides of a vault box, the sheet having a front, a rear, a left side, and a right side, the sheet having an opening at the front between the left side and right side that converges and extends part way to the rear of the sheet, the opening adapted to overlie a recess of a vault box, the opening having a rear inner wall, a left inner wall, and a right inner wall; (b) a left wing descending from the left inner wall and extending from the front of the opening part way to the rear inner wall of the opening, the left wing adapted to extend downwardly against a left wall of a vault box part way to a bottom surface and part way to a rear wall of a vault box; and (c) a right wing descending from the right inner wall and extending from the front of the opening part way to the rear inner wall of the opening, the right wing adapted to extend downwardly against a right wall of a vault box part way to a bottom surface and part way to a rear wall of a vault box.

The vault box safety collar of this invention reduces the risk of catastrophic injury if the pole vaulter lands directly onto the vault box, but does not make it more difficult for the pole vaulter to plant the pole into the vault box.

DETAILED DESCRIPTION OF THE INVENTION

Figure 2:
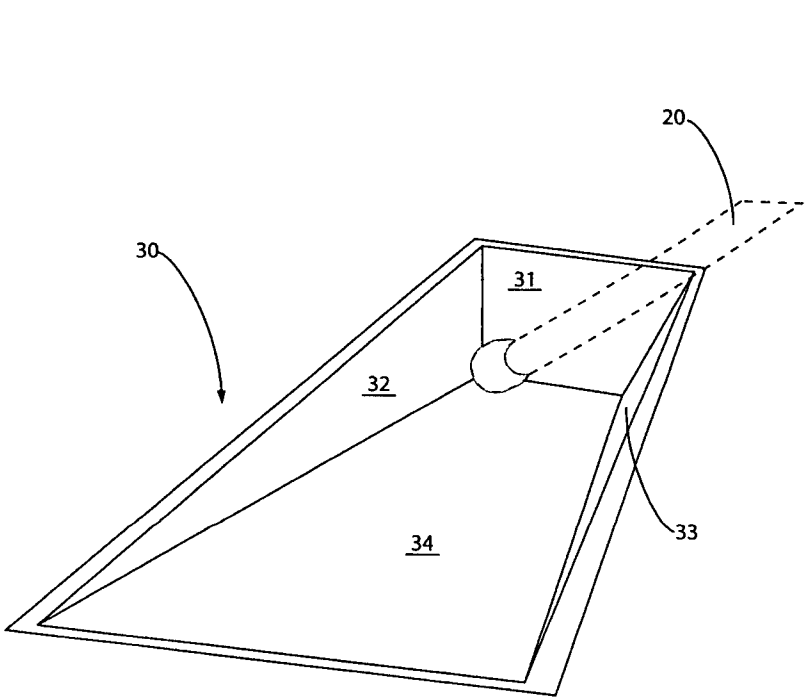
FIG. 2 Prior Art
FIG. 2 is a perspective view of a prior art vault box.
Figure 1:
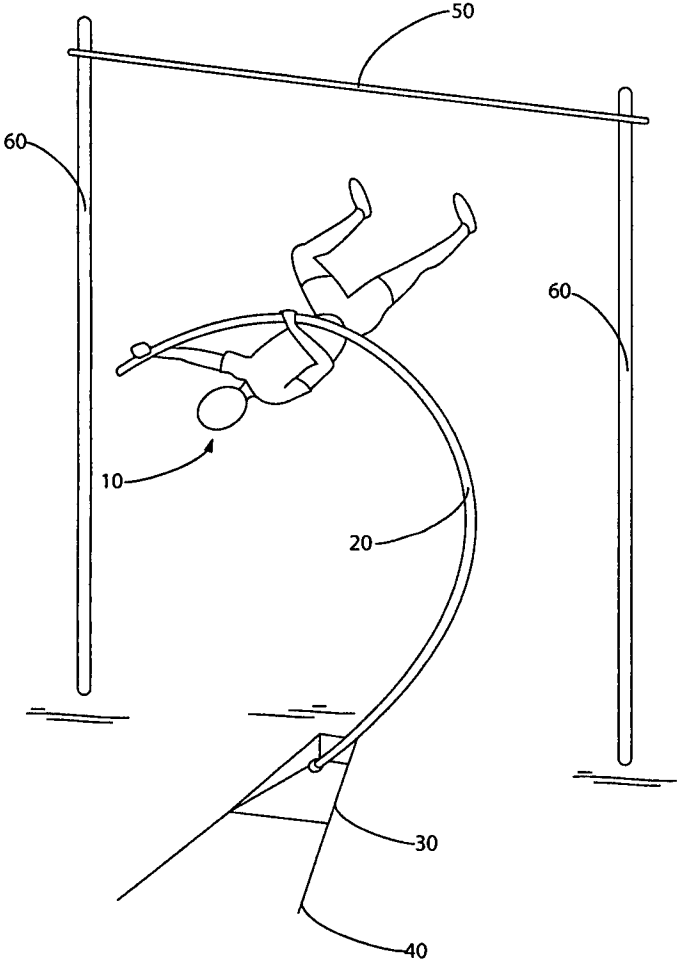
FIG. 1 Prior Art
FIG. 1 is a perspective view of a prior art pole vaulter performing a vault.

This invention is best understood by reference to the drawings. Referring first to FIGS. 5 to 11, the vault box safety collar 70 of this invention is adapted for placement on, and partially into, a standard vault box. The front of the safety collar mounts flush with the front of the vault box. The sides and rear of the safety collar overlie the surface adjacent to the sides and rear of the vault box. The safety collar comprises a sheet of cushioned material with a front 71, a rear 72, a left side 73, and a right side 74. The sheet generally has a thickness of about one to five inches (about 3 to 13 cm), and preferably has a thickness of about two to four inches (about 5 to 10 cm).

An opening 75 in the sheet extends from the front a portion of the way toward the rear. The opening gives the sheet a general shape commonly known as horseshoe (also known as U-shape). The opening converges from front to rear and overlies the recess of the vault box. The inner walls of the opening taper outwardly at an angle of about 95 to 115 degrees, preferably about 105 degrees, to conform to the angle of the side and rear walls of the vault box. The rearward portion 76 of the opening is adapted to fit exactly over the rearward portion of the vault box recess. The inner wall angle and the opening shape ensure that the safety collar does not contact or interfere with a vaulting pole planted against the rear wall of the vault box.

The safety collar contains two wings 77 and 78 (also known as side panels) that descend from the inner walls of the opening and extend downwardly along the upper portions of the side walls of the vault box. The purpose of the wings is to cushion and reduce the size of the top of the opening while not interfering with the planting or bending of the pole during the vault. Each wing runs from the front of the safety collar part way toward the rear inner wall of the opening. This distance is generally about 35 to 37 inches (about 89 to 94 cm), preferably about 36 inches (about 90 cm), so each wing ends at a point that is about five to eight inches (about 13 to 20 cm), preferably about seven inches (about 18 cm), forward of the rear wall of the opening. As can be seen in the drawings, the wings give the opening a notched back shape at the rear.

Figure 11:
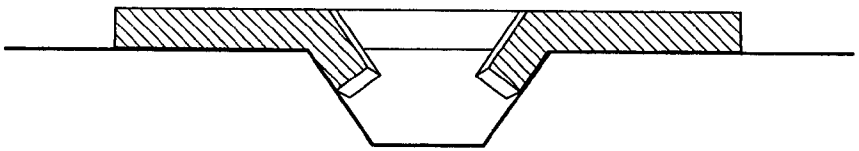
FIG. 11 is a section taken along line 11-11 in FIG. 10.
Figure 10:
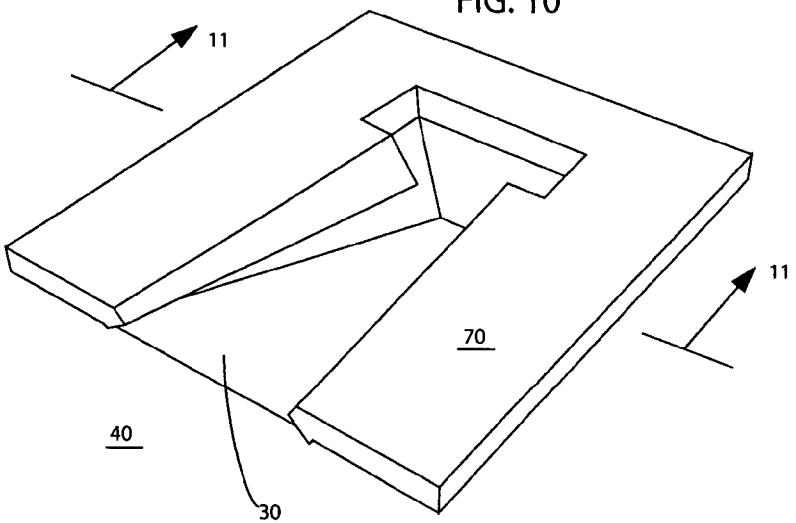
FIG. 10 is a front, top, and right side perspective view of the safety collar mounted onto a vault box.

Each wing runs from the top of a vault box side wall downward a distance that is only part way to the bottom surface of the vault box. This distance is preferably about one-half to one inch (about 1 to 3 cm) at the front of each wing and about five to six inches (about 13 to 15 cm) at the rear of each wing (measured from the top of the vault box). The distance increases from front to rear because the bottom surface of the vault box slopes downwardly toward the rear and the depth of the side walls increase correspondingly. As best seen in FIG. 11, the wings do not cover the lower portion of the side walls of the vault box. At the rear of the wings, a space of about two to three inches (about 5 to 8 cm) exists between the bottom surface of the wings and the bottom of the vault box. The wings generally have a thickness of about one to five inches (about 3 to 13 cm), and preferably have a thickness of about two to four inches (about 5 to 10 cm). If desired, the thickness of the wings decreases from top to bottom. The decrease in thickness is achieved with an angled notchback (as shown in the drawings) or with a taper.

Figure 4:
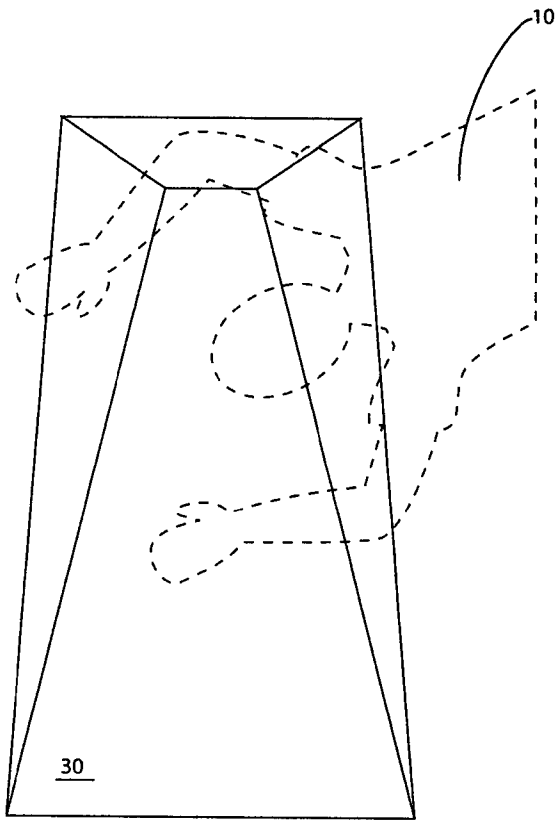
FIG. 4 Prior Art
FIG. 4 is a perspective view of a second type of vault box injury.
Figure 3:
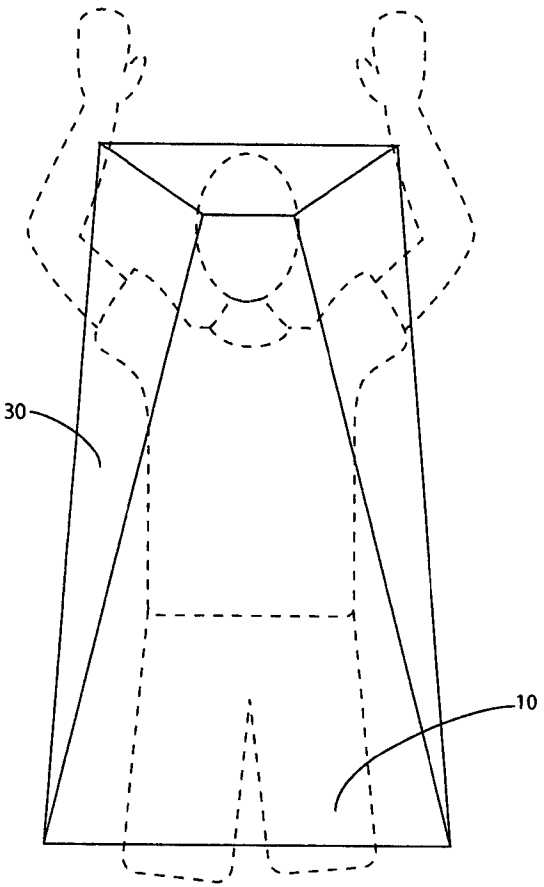
FIG. 3 Prior Art
FIG. 3 is a perspective view of a first type of vault box injury.
Figure 6:
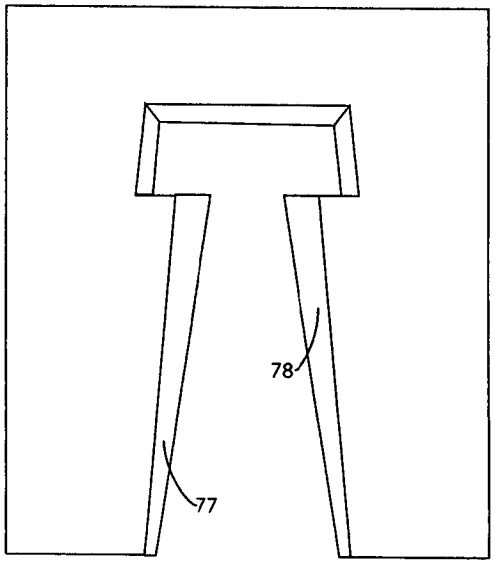
FIG. 6 is a top plan view of the safety collar.
Figure 8:
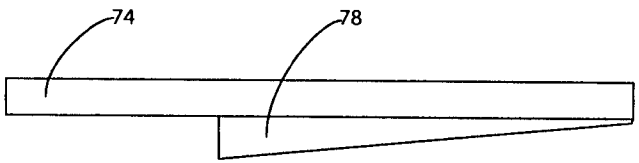
FIG. 8 is a right side elevation view of the safety collar.
Figure 5:
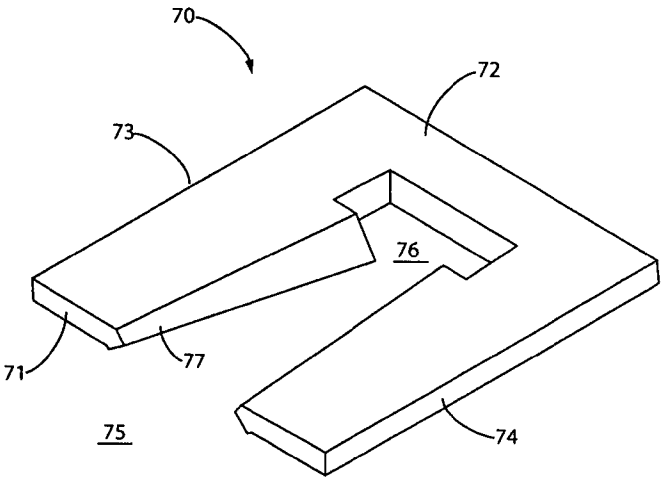
FIG. 5 is a front, top, and right side perspective view of a preferred embodiment of the vault box safety collar of this invention.
Figure 7:
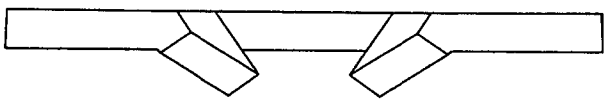
FIG. 7 is a front elevation view of the safety collar.
Figure 9:
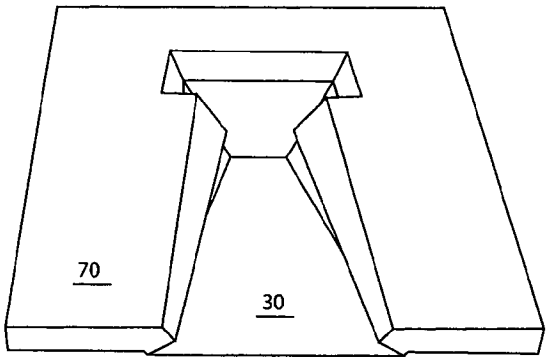
FIG. 9 is a front and top perspective view of the safety collar mounted onto a vault box.

The shape and size of the wings are important in reducing the risk of catastrophic injury. It has been surprisingly discovered that the wings reduce the size of the top opening in such a way that a vaulter who lands directly over the vault box in a parallel position has his body restrained (and his fall cushioned) rather than landing on the bottom surface of the vault box (as illustrated in FIG. 3). It has also been surprisingly discovered that the wings also reduce the size of the top opening in such a way that a vaulter who lands directly over the vault box in a transverse position with his head over the opening has his head cushioned rather than having it thrown backward and downward against the bottom surface of the vault box (as illustrated in FIG. 4). In summary, it has been surprisingly been discovered that the relatively small reduction in the size of the top opening created by the wings is responsible for a dramatic change in the type of injuries suffered. It is estimated that a vaulter is ninety percent less likely to contact the hard surface of the vault box when the vault box safety collar of this invention is in place.

While reducing the risk of catastrophic injury, it has been surprisingly discovered that the shape and size of the wings do not interfere with the planting of the pole during a vault. During a vault, the pole is planted on the lower surface of the vault box at a very acute angle (near horizontal). The vaulter retains the full width of the vault box in which to plant the pole because the wings do not contact the lower surface of the vault box.

Furthermore, the shape and size of the wings do not interfere with the bending of the pole during a vault. More specifically, the wings do not extend all the way to the rear wall of the vault box. As illustrated in FIG. 2, the pole bends from one rear corner toward the opposite rear corner during the vault. Accordingly, the planted pole does not contact the wings during the vault.

The overall dimensions of the safety collar are, to some extent, matters of choice. At the minimum, the safety collar extends to the rear and both sides of the vault box a distance of at least about five inches (about 13 cm) as measured from the stop board and from the side walls. The preferred embodiment of the safety collar has a length of about 50 to 60 inches (about 127 to 152 cm) and thus extends to the rear of the vault box a distance of about seven to seventeen inches (about 18 to 43 cm). The most preferred embodiment of the safety collar has a length of about 54 inches (about 140 cm) and thus extends to the rear of the vault box a distance of about eleven inches (about 28 cm). The preferred embodiment has a width of about 44 to 54 inches (about 112 to 137 cm) and thus extends outwardly from the front opening a distance of about ten to fifteen inches (about 25 to 38 cm) on each side. The most preferred embodiment has a width of about 48 inches (about 122 cm) and thus extends outwardly from the front opening a distance of about twelve inches (about 30 cm) on each side. The preferred embodiment has a thickness of about two to four inches (about 5 to 10 cm) and most preferably has a thickness of about three inches (about 8 cm).

If desired, the safety collar is incorporated into a much larger landing cushion around the vault box, commonly known as the front buns. In such a case, the entire cushion can be considered to be the safety collar and it may be several feet in length, width, and thickness (height).

The safety collar is made of materials of the type commonly used for cushions. The preferred materials are a dense foam covered by a waterproof sheet material. The most preferred materials are a polyurethane foam covered by vinyl sheeting.

We claim:

1. A safety collar for a vault box installed into a horizontal surface in front of pole vaulting standards, the vault box having a front, a rear, a left side, and a right side, the vault box forming a recess having a bottom surface that slopes downwardly from front to rear, an outwardly sloping rear wall, an outwardly sloping left wall that converges from front to rear, and an outwardly sloping right wall that converges from front to rear, the safety collar comprising:

(a) a cushioned sheet of material adapted to overlie the horizontal surface adjacent to the rear, the left side, and the right side of a vault box, the sheet having a front, a rear, a left side, a right side, and a bottom defining a horizontal plane, the sheet having an opening at the front between the left side and right side that converges and extends part way to the rear of the sheet, the opening adapted to overlie a portion of the recess of a vault box, the opening having a rear inner wall, a left inner wall, and a right inner wall;

(b) a left wing descending from the left inner wall below the horizontal plane defined by the bottom of the sheet and extending from the front of the opening part way to the rear inner wall of the opening, the left wing adapted to extend downwardly against a left wall of a vault box part way to a bottom surface and part way to a rear wall of a vault box; and (c) a right wing descending from the right inner wall below the horizontal plane defined by the bottom of the sheet and extending from the front of the opening part way to the rear inner wall of the opening, the right wing adapted to extend downwardly against a right wall of a vault box part way to a bottom surface and part way to a rear wall of a vault box.

2. The safety collar of claim 1 wherein the inner walls of the opening slope outwardly at an angle of about 95 to 115 degrees.

3. The safety collar of claim 1 wherein the distance between the front and rear of the sheet is about 50 to 60 inches and the distance between the left side and right side of the sheet is about 44 to 54 inches.

4. The safety collar of claim 1 wherein each wing has a front and a rear and wherein each wing extends downwardly a distance of about one-half to one inch at the front and about five to six inches at the rear.

5. The safety collar of claim 1 wherein each wing has a thickness of about two to four inches.

6. A vault box and safety collar assembly comprising:

(a) a vault box having a front, a rear, a left side, a right side, and a top defining a horizontal plane, the vault box defining a recess having a bottom surface that slopes downwardly from front to rear, an outwardly sloping rear wall, an outwardly sloping left wall that converges from front to rear, and an outwardly sloping right wall that converges from front to rear; and (b) a cushioned safety collar overlying the vault box and an area to the rear and the sides of the vault box on the horizontal plane defined by the top of the vault box, the collar having a front, a rear, a left side, and a right side, the collar having an opening with inner walls extending from the front part way to the rear that overlies the recess of the vault box, the collar having a left wing extending downwardly against the left wall of the vault box below the horizontal plane defined by the top of the vault box part way to the bottom surface and part way to the rear wall and a right wing extending downwardly against the right wall of the vault box below the horizontal plane defined by the top of the vault box part way to the bottom surface and part way to the rear wall.

7. The vault box and safety collar assembly of claim 6 wherein each wing has a front and a rear and wherein each wing extends downwardly a distance of about one-half to one inch at the front and about five to six inches at the rear.

8. The vault box and safety collar assembly of claim 6 wherein the distance between the front and rear of the safety collar is about 50 to 60 inches and the distance between the left side and right side of the safety collar is about 44 to 54 inches.

9. The vault box and safety collar assembly of claim 6 wherein the inner walls of the opening slope outwardly at an angle of about 95 to 115 degrees.

10. The vault box and safety collar assembly of claim 6 wherein each wing has a thickness of about two to four inches.

11. A method for pole vaulting using a vault box installed into an adjacent surface in front of pole vaulting standards, the adjacent surface defining a horizontal plane, the vault box having a front, a rear, a left side, a right side, and a recess having a bottom surface that slopes downwardly from front to rear, an outwardly sloping rear wall, an outwardly sloping left wall that converges from front to rear, and an outwardly sloping right wall that converges from front to rear, the method comprising placing a safety collar on the vault box, the safety collar comprising a cushioned safety collar that overlies a portion of the vault box and the adjacent surface to the rear and the sides of the vault box, the collar having a front, a rear, a left side, and a right side, the collar having an opening with inner walls extending from the front part way to the rear, the collar having a left wing extending downwardly against the left wall of the vault box below the horizontal plane defined by the adjacent surface part way to the bottom surface and part way to the rear wall and a right wing extending downwardly against the right wall of the vault box below the horizontal plane defined by the adjacent surface part way to the bottom surface and part way to the rear wall.

12. The method of claim 11 wherein each wing has a front and a rear and wherein each wing extends downwardly a distance of about ones-half to one inch at the front and about five to six inches at the rear.

13. The method of claim 11 wherein the distance between the front and rear of the safety collar is about 50 to 60 inches and the distance between the left side and right side of the safety collar is about 44 to 54 inches.

14. The method of claim 11 wherein the inner walls of the opening slope outwardly at an angle of about 95 to 115 degrees.

15. The method of claim 11 wherein each wings has a thickness of about two to four inches.

* * * * *